US007866782B2

(12) United States Patent
Borton

(10) Patent No.: US 7,866,782 B2
(45) Date of Patent: Jan. 11, 2011

(54) SYSTEM FOR OPTICALLY DETECTING AND MEASURING RELEASE AGENT ON A PRINT DRUM IN AN INK JET PRINTER

(75) Inventor: Michael D. Borton, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 946 days.

(21) Appl. No.: 11/784,674

(22) Filed: Apr. 9, 2007

(65) Prior Publication Data

US 2008/0246796 A1 Oct. 9, 2008

(51) Int. Cl.
*B41J 29/393* (2006.01)
*B41J 2/01* (2006.01)

(52) U.S. Cl. ..... 347/19; 347/103

(58) Field of Classification Search ..... 347/19, 347/103

See application file for complete search history.

(56) References Cited

U.S. PATENT DOCUMENTS 5,099,256 A * 3/1992 Anderson ..... 347/103
5,262,830 A * 11/1993 Inaishi ..... 399/49
6,263,182 B1 7/2001 Baker et al.
6,347,197 B1 2/2002 Maul et al.
7,123,848 B2 10/2006 Clement et al.
2005/0110854 A1 5/2005 Roof
2007/0003302 A1 1/2007 Mizes

FOREIGN PATENT DOCUMENTS

EP 1681602 A1 7/2006

OTHER PUBLICATIONS

European Search Report, European Patent Office, Munich, DE, Jul. 20, 2009, 8 pages.

* cited by examiner

*Primary Examiner*—Matthew Luu
*Assistant Examiner*—Kendrick X Liu
(74) *Attorney, Agent, or Firm*—Maginot, Moore & Beck LLP

(57) ABSTRACT

A system optically detects and measures release agent on a rotating image member in an ink jet printer. The system includes a collimated light source oriented to direct a collimated beam of light generated by the source towards a rotating image member, an image sensor for generating an image of a portion of the rotating image member from a portion of the collimated beam of light reflected by the rotating image member, an image differentiator for measuring a difference between a first image generated by the image sensor and a second image generated by the image sensor, and a release agent measurement generator that is coupled to the image differentiator to receive the difference between the two images and to generate a measurement of the release agent on the rotating image member.

17 Claims, 4 Drawing Sheets

SYSTEM FOR OPTICALLY DETECTING AND MEASURING RELEASE AGENT ON A PRINT DRUM IN AN INK JET PRINTER

TECHNICAL FIELD

This disclosure relates generally to ink jet printers, and, more particularly, to release agent systems used to apply release agent to intermediate image members in printers.

BACKGROUND

Ink jet printers have print heads that operate a plurality of ejection jets from which liquid ink is expelled. The ink may be stored in reservoirs located within cartridges installed in the printer, or the ink may be provided in a solid form and then melted to generate liquid ink for printing. In these solid ink printers, the solid ink may be in either pellets or ink sticks. The solid ink pellets or ink sticks are typically placed in an "ink loader" that is adjacent to a feed chute or channel. A feed mechanism moves the solid ink sticks from the ink loader into the feed channel and then urges the ink sticks through the feed channel to a heater assembly where the ink is melted. In some solid ink printers, gravity pulls solid ink sticks through the feed channel to the heater assembly. Typically, a heater plate ("melt plate") in the heater assembly melts the solid ink impinging on it into a liquid that is delivered to a print head for jetting onto a recording medium.

After the ink is provided to the print head, it is ejected from print head orifices across an open gap to a receiving member to form an image. The receiving image member may be a revolving print drum or other intermediate offset member, such as a rotating belt. The image generated on the offset member is transferred to media that comes into contact with the rotating member. To facilitate the image transfer process, a pressure roller, sometimes called a transfix or transfer member, presses the media against the print drum. Specifically, the leading edge of the media is fed into a nip between the intermediate member and a transfix member so the two rotating members push the media through the nip for the transfer of the image from the intermediate member to the media. Offset printing refers to a process, such as the one just described, of generating an ink or toner image on an intermediate member and then transferring the image onto some recording media or another member.

In some offset printers, a release agent system is used to facilitate the transfer of the image from the offset image member to the media. The release agent system typically includes a release agent source and a release agent applicator. The release agent is typically a silicone oil or the like that may be applied to the rotating image member to produce a thin layer of release agent on the member. This layer reduces the adhesion of the ink to the image member. This reduction facilitates the transfer of the image to the media. Regulating the amount of release agent applied to an image member is important as too much release agent results in smeared images or oil stains on the media. Consequently, many release agent systems include a metering member that acts as a squeegee to remove excess release agent from an image member. Level sensors may also be used in the release agent source to detect a near exhaustion condition for the release agent source. Actually measuring release agent amount or level on an image member, however, is not known.

Although release agent is not applied to an image member in a toner printer, many toner printers include release agent systems. In toner printers, a rotating image member is typically a photoreceptor belt or drum. A light source is controlled with image data to remove charge from the photoreceptor belt to form a latent image of a document or the like. The latent image is then developed in a development station where a toner cloud is generated and toner is attracted to the latent image. The toner image is then transferred to media by bringing the media into contact with the toner image and applying charge to the back side of the media. The toner is attracted to the media. The media then moves to a fuser station where the media passes through a pair of heated rollers to fuse the image to the media. These heated rollers are frequently called fuser rolls.

Because heated toner displays some degree of tackiness, the heated toner may attempt to remain in contact with one of the fuser rolls and impede the progress of the media along its feed path to a discharge area. To facilitate separation of media from a fuser roll, release agent may be applied by a release agent system to one or both fuser rolls. The layer of release agent helps reduce the adhesion of the media to a fuser roll so the media separates from the fuser roll and continues to the discharge area. Again, metering of the release agent onto the fuser rolls is important because too much release agent soils or otherwise degrades the quality of the media and the image on it.

In one known toner printer, an optical system for detecting oil on a fuser roll is known. The optical system directs a light onto the fuser roll and the amount of reflected light is used to determine whether or not there is a sufficient amount of oil on the fuser roll. Such an optical system, however, cannot be used on a print drum in an ink jet or solid ink printer to measure release agent on an image member. One reason that the optical system of the toner printer cannot be used to measure release agent on a print drum arises from the differences in surface textures and base reflectivity between print drums and fuser rolls. Print drums have anodized and etched surfaces. Consequently, the voids in the surface of print drums are microscopic and the base reflectivity is relatively high compared to fuser rolls. These characteristics render known optical sensing systems ineffective for measuring the amount of release agent on the surface of the drum.

Light sensing systems are used in toner printers to evaluate the developed mass of toner applied to a photoreceptor. These systems include a light source and a light sensor. In one typical system, an ETAC sensor is configured and positioned to direct a collimated beam of light towards a photoreceptor, which reflects the light towards a plurality of photodetectors. This configuration enables the sensor to detect differences between a toned patch and the untoned photoreceptor. The light source generates a collimated light beam having a fairly constant diameter. The light also has a dominant wavelength that may be in the visible or infrared spectrum. For example, one ETAC sensor uses a light source that generates a light beam approximately four millimeters wide with a wavelength of approximately 940 nanometers.

An ETAC sensor may be used to detect release agent on a fuser roll in a toner printer. The base reflectivity combined with the pores and ridges in a fuser roll are sufficient to absorb and scatter the incident beam to allow a small amount of the incident light to be returned to the sensor's detectors in an un-oiled state. As the fuser roll surface fills with oil, the irregularities are reduced, the surface becomes smoother, and more of the light is returned to the sensor, rather than being scattered. Thus, the greater the amount of oil on the surface of the fuser roll, the greater the intensity of the light at the sensor.

The base reflectivity of an anodized and etched print drum, however, is so high in comparison to a fuser roll, that the light reflects off of the bare surface of the print drum in practically the same manner as it does when the surface is covered with release agent. That is, the field of view and detection methods are inadequate to separate the changes in surface characteristics as the amount of oil applied to the surface varies.

While a light detection and measurement system for release agent is desirable, because it does not mechanically disturb the oil layer, known systems are ineffective for detecting and measuring release agent on the substantially smoother image members of ink jet printers. A system for detecting and measuring release agent on a print drum and the like would be an improvement over the level sensing sensors currently used in such printers.

SUMMARY

A system has been developed that optically detects and measures release agent on a rotating image member in an ink jet printer. The system includes a collimated light source or a coherent light source that is oriented to direct a beam of light generated by the source towards a rotating image member, an image sensor for generating an image of a portion of the rotating image member from a portion of the beam of light reflected by the rotating image member, an image differentiator for measuring a difference between a first image generated by the image sensor and a second image generated by the image sensor, and a release agent measurement generator that is coupled to the image differentiator to receive the difference between the two images and to generate a measurement of the release agent on the rotating image member.

An ink jet printer may implement a method for optically detecting and measuring release agent on a rotating image member. The method includes directing either a collimated beam of light or a coherent beam of light towards a rotating image member, generating an image of a portion of the rotating image member from a portion of the beam of light reflected by the rotating image member, measuring a difference between a first image generated by the image sensor and a second image generated by the image sensor, and generating a measurement of the release agent on the rotating image member that corresponds to the measured difference between the first image and the second image.

DETAILED DESCRIPTION

Figure 1:
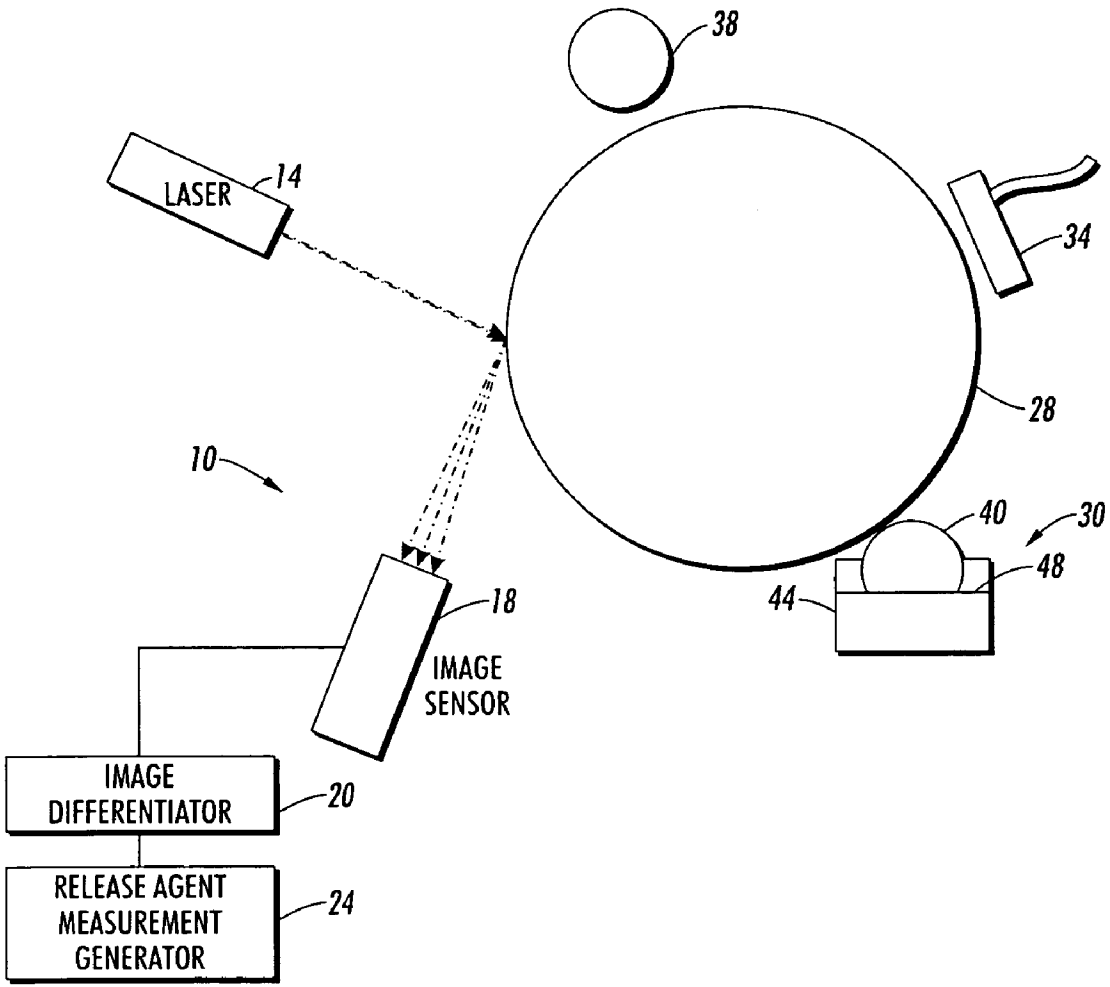
FIG. 1 is a simplified perspective view of an optical release agent measurement system mounted in relationship to a rotating image member.

Like reference numerals refer to like parts throughout the following description and the accompanying drawings.

An optical system for detecting and measuring release agent on a rotating image member is shown in FIG. 1. The system 10 includes a collimated light source 14, an image sensor 18, an image differentiator 20, and a release agent measurement generator 24. The system 10 is mounted in proximity to a rotating image member 28 that has release agent applied to it by a release agent system 30. One or more print heads 34 are located near the image member 28 to eject ink onto the image member. A transfix roller 38 is located for movement into and out of engagement with the image member to facilitate the transfer of an ink image on the image member 28 to media that travels through a nip formed between the transfix roller 38 and the image member 28 when they engage one another.

In more detail, the rotating image member 28 is an anodized and etched aluminum drum. The process used to manufacture the print drum produces a surface with microscopic pits in it. These pits help pin the ink ejected from a print head 34 to the drum 28. While the rotating image member 28 is described as being a print drum, the system 10 may also work with rotating print belts and the like having the same surface characteristics as those described for the print drum.

An image is generated on the print drum by ejecting ink from a print head 34. The ink may be supplied from a reservoir of ink obtained by melting solid ink sticks or pellets. The solid ink supply may be replenished by inserted more solid ink sticks or pellets that are urged through a feed channel to a melting assembly where the solid ink is heated to a melting temperature to generate more ink for the printer. Alternatively, the ink may be supplied by ink cartridges with a fixed supply of liquid ink. Image data are obtained from electronic documents or light scans of physical documents. These data are used to generate a stream of pixel data that is used by a print head controller to generate a driving signal for the piezoelectric actuators in a print head. In response to the driving signal, the piezoelectric actuators selectively eject ink from the print head across a gap to the print drum 28. One or more revolutions of the print drum may be required to form an image on the print drum.

The release agent system 30 may include a release agent roller 40 and a release agent supply 44. The release agent supply contains a reservoir of release agent 48, such as a silicone oil having a suitable viscosity. The release agent supply 44 may act as a sump in which the release agent roller 40 is partially submerged. The release agent roller 40 may be mounted on moveable links to bring the roller into and out of engagement with the print drum for the selective application of release agent to the print drum. A metering blade (not shown) may be included in the release agent system 30 to spread the release agent more evenly over the print drum and to remove excess release agent from the print drum. The metering blade may be moveable so it may selectively engage the print drum. Additionally, the position of the metering blade may be adjustable with respect to the print drum so the amount of release agent permitted to stay on the drum may be varied. The release agent remaining on the print drum partially fills the voids of the print drum to alleviate the accumulation of ink within the voids and to help reduce the adhesion of ink to the print drum. The reduction in adhesion aids in the transfer of the ink image to media.

When an image is to be transferred to media, a media sheet may be retrieved from a media supply and transported along a path towards the gap between the transfix roller 38 and the print drum 28. The transfix roller is mounted on moveable links so it may be moved into and out of engagement with the print drum. As the media is being brought to the print drum for transfer of the image, the transfix roller is brought into contact with the print drum. In some printers, the image member is brought to a halt so the transfix member can be moved into contact with the print drum and then the print drum resumes rotation to impart rotational momentum to the transfix roller. When the transfix roller and the print drum reach the appropriate speed, the leading edge of the media is slipped into the nip between the transfix roller and the print drum so it passes through the nip. The movement of the media through the nip is synchronized with the rotation of the image on the print drum so the image is transferred to the media as it passes through the nip.

In an effort to assess whether an appropriate amount of release agent is present on a rotating image member, an optical release agent measurement system has been developed. The system 10 includes a source of collimated light 14. Although the collimated source of light 14 is shown in FIG. 1 as being a laser, other collimated light sources are possible. For example, the collimated light source 14 may be a helium-neon (He—Ne) laser or a gallium-arsenide (GaAs) laser. These lasers have wavelengths of approximately 650 and 840 nanometers (nm), respectively. Collimated light sources, such as a light emitter of an enhanced toner area coverage (ETAC) sensor, have a wavelength of approximately 940 nm. The light from an infrared emitter of an ETAC sensor, however, is adequate for sensing changes in the surface of a print drum provided that the detection method is adjusted for measuring the relatively smooth surface of an anodized and etched aluminum drum.

The light emitted by the light source 14 is reflected by the rotating image member 28. An image sensor 18 is located at a position to receive the light reflected from the surface of the image member. That is, the sensor 18 is positioned so it receives the center of the light beam from source 14 when the surface of the drum acts as a mirror. The distances between the light source 14, the print drum 28, and the image sensor 18 in FIG. 1 are exaggerated for purposes of illustration. As noted above, a properly designed sensor may be mounted in proximity to the print drum to provide the collimated light source 14 and the image sensor 18. In other embodiments, the collimated light source 14 and image sensor 18 may not necessarily be integrated into a single unit. The image sensor 18 may be a two-dimensional array of photosites, such as a digital image sensor. Each photosite in such an array generates an electrical signal that corresponds to the intensity of the reflected light impinging on the photosite. Consequently, the pattern of the reflected light may be ascertained by the pattern of the electrical signals generated by the photosite array.

Figure 2A:
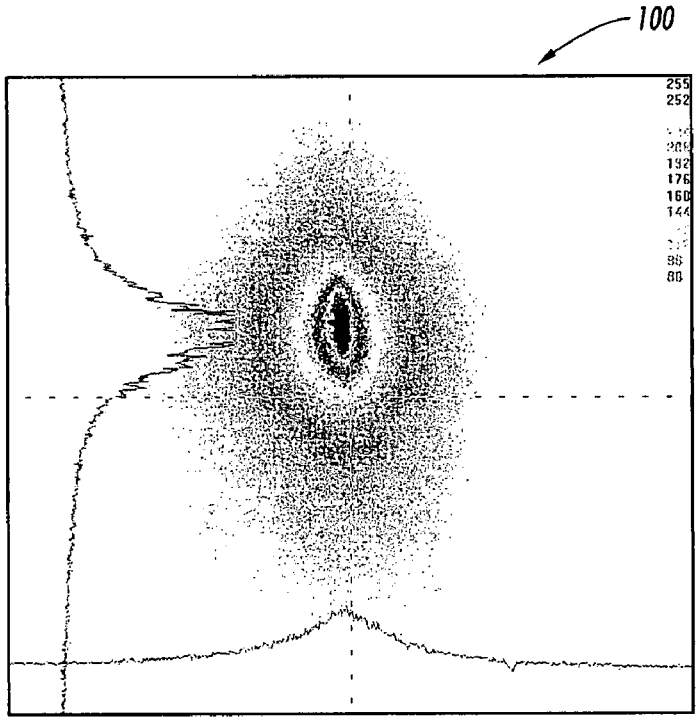
FIG. 2A is an image generated by the optical system of FIG. 1 that shows a reflection of collimated light from a portion of the rotating image member on which no release agent is present.
Figure 2B:
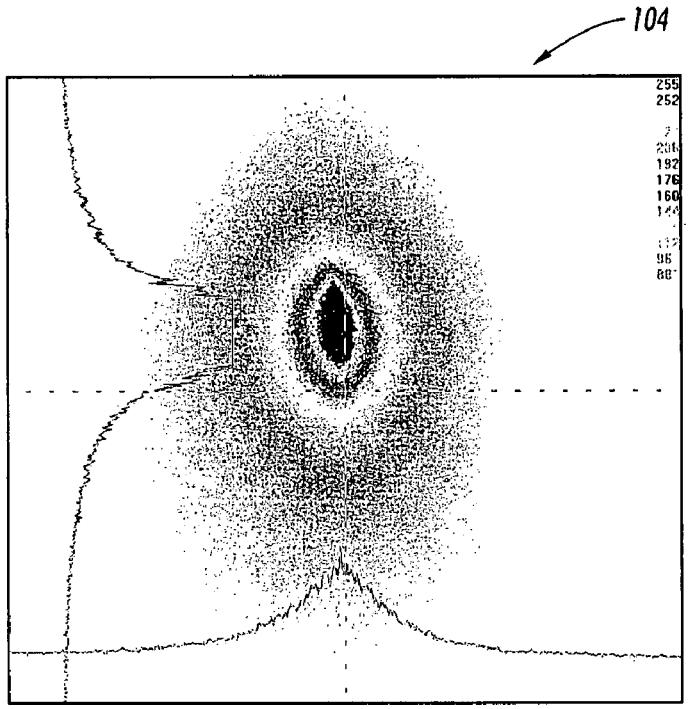
FIG. 2B is an image generated by the optical system of FIG. 1 that shows a reflection of collimated light from a portion of the rotating image member on which release agent is present.

The image differentiator 20 is coupled to the image sensor 18 to receive the signals generated by the sensor on a periodic or polled basis. An image received at a first time may be stored in a memory for comparison with one or more subsequent images. An image received at a second time may also be stored in memory or simply compared to the first image. Examples of images generated by an image sensor 18 are shown in FIG. 2A and FIG. 2B. In FIG. 2A, the image shows the light pattern 100 reflected by a print drum having no oil on its surface. The light pattern 104 reflected by a print drum having oil on its surface is shown in FIG. 2B. The light pattern 104 in FIG. 2B shows less scattering of the light. The light is reflected more specularly because the oil has begun to fill the voids in the print drum so less of the light encounters the underlying irregular structure.

Figure 3A:
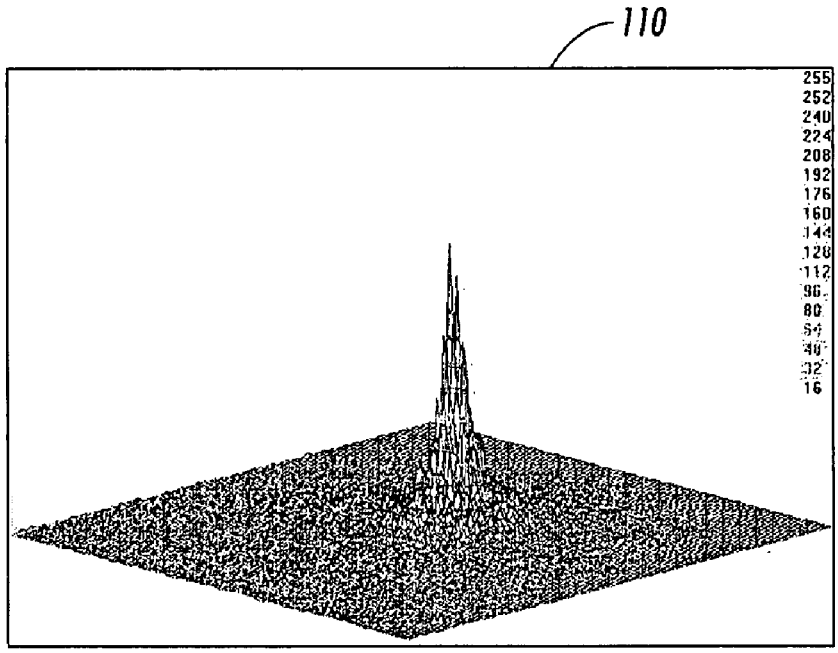
FIG. 3A is a three dimensional profile of the image shown in FIG. 2A.
Figure 3B:
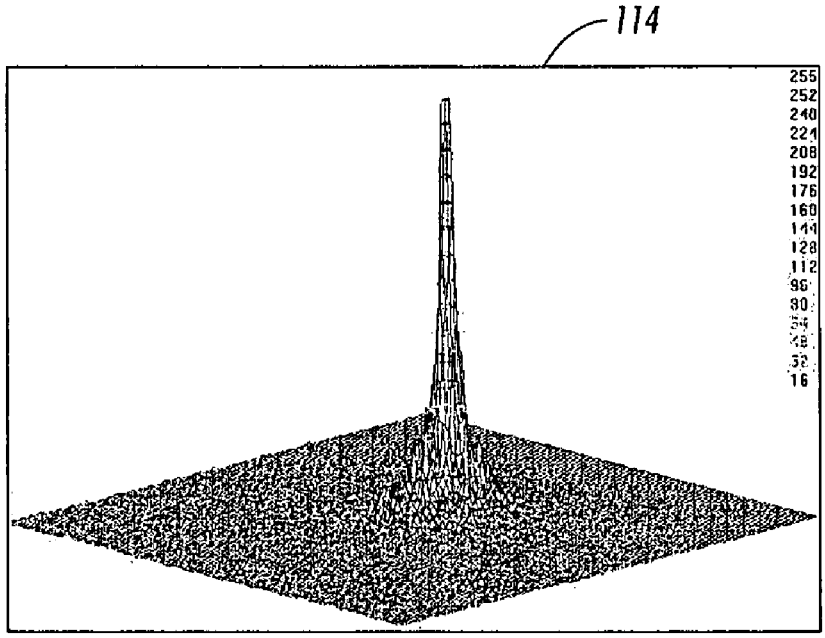
FIG. 3B is a three dimensional profile of the image shown in FIG. 2B.

To enhance the visualization of the concept, a three dimensional profile for each of the two reflection patterns illustrated in FIG. 2A and FIG. 2B is shown in FIG. 3A and FIG. 3B. A comparison of these two figures reveals a central region where the intensity of the reflected light is the greatest. The three dimensional profile for the surface without release agent has a central region 110 with an intensity that is less than the intensity of the central region 114 of the oiled surface. Additionally, the central region 114 of the oiled surface is larger in area than the central region 110 of the reflection from the surface without oil These differences, as well as others, may be used to process the images generated by the image sensor 18 to detect and measure the amount of release agent on the surface of a print drum.

Figure 4:
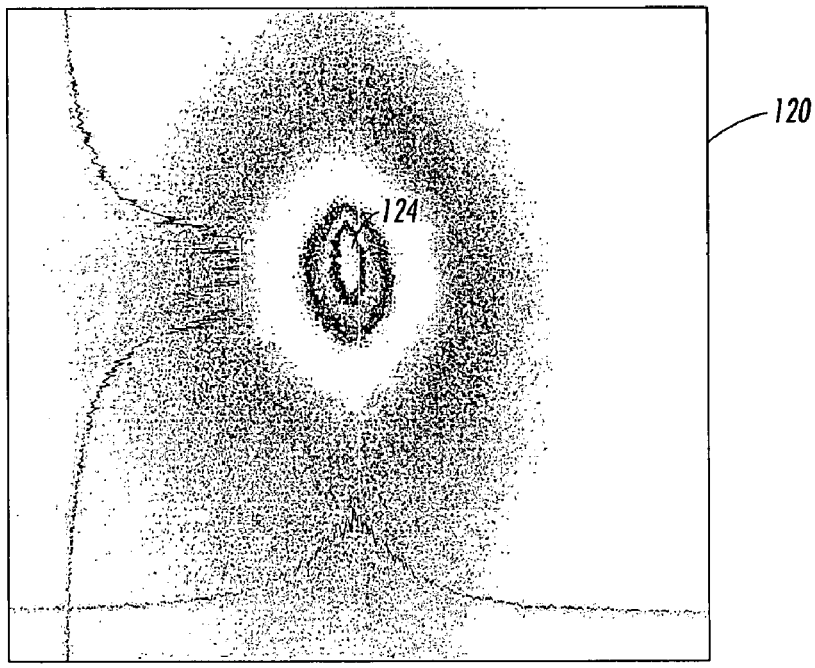
FIG. 4 is an image of the differences between the image shown in FIG. 2A and FIG. 2B.

The difference between the two images shown in FIG. 2A and FIG. 2B is shown in FIG. 4. This difference image 120 may be derived by subtracting the electrical signals generated by the photosite array at two different times. Thus, the image differentiator 20 may be implemented by hardware configured for signal processing. Alternatively, the signals generated by the photosites in a two dimensional array may be converted to data values for processing by a processor executing a sequence of programmed instructions. Thus, the image differentiator may be implemented as a processor system controlled by software instructions. In yet another embodiment, hardware components and software may be integrated to perform different tasks and functions to generate differences between images received from the image sensor 18 and evaluate those differences. The differences image 120 may be stored in memory for access by the release agent measurement generator 24 or it may be provided to the release agent measurement generator 24 for further processing.

Again with reference to FIG. 4, the central region 124 is shown as a cluster of photosite differences having an intensity that is substantially less than the differences in the area surrounding the central region 124. The relatively smooth region around the center indicates that the light received in this region has increased significantly, while the light in the central region is practically the same. This increase in light intensity is attributable to the release agent filling the voids in the print drum surface so less light is scattered and more light is directed towards the center. Similarly, changes in the size of the central region or in the outlying regions of the differences image 120 may be used to determine the amount of release agent on the drum.

To this end, the release agent measurement generator 24 includes hardware, software, or a combination of both, as noted above with respect to the image differentiator 20, to quantify the difference values and generate a measurement of the release agent. Also, the reader should appreciate that the image differentiator 20 and the release agent measurement generator 24 may be implemented in an integrated hardware, software, or combination system.

The release agent measurement generator 24 may sum all of the data values or signals of the differences image 120 or only the data values or signals for a select portion of the differences image 120. Alternatively, the number of pixels in an image obtained by a photosite array that exceed a threshold may be summed or otherwise mathematically processed to obtain a relative measure of the oil level from one sampling period to another. For example, the data values or signals of the central region 124 may be summed to obtain an intensity value or signal for that region. This value may then be compared to an intensity threshold to determine the relative amount of release agent present on the print drum. A single intensity threshold may be used or a series of intensity thresholds may be used. These intensity thresholds may be established by empirical observation and testing and correlated to empirical measurements of the release agent amounts present on the drum. In one embodiment, the intensity threshold or thresholds are established for correlation with oil amounts in the range of about 50 to about 250 nm in thickness. These values may be also be plotted and a corresponding function determined. An incremental value for a release agent measurement may be determined from these observations and/or functions and correlated to intensity changes. Thus, the release agent measurement generator 24 may determine a difference between an intensity for a central region, for example, at a first time and an intensity for the same region at a second time and add the corresponding increment to the current release agent measurement. Of course, the increment may be negative as well as positive so the measurement may decrease as well as increase.

Figure 5:
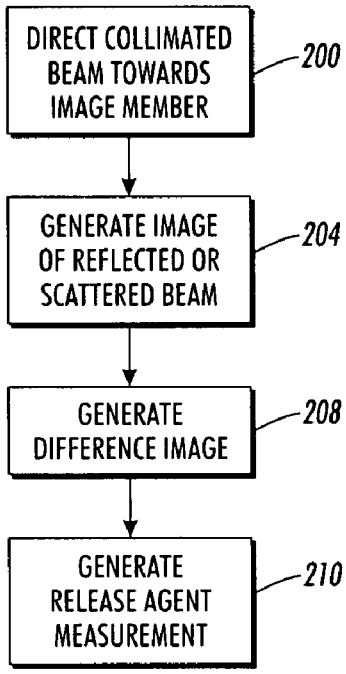
FIG. 5 is a flow diagram of a process that may be implemented by the optical release agent measurement system shown in FIG. 1.

The system 10 may be described as implementing a method of release agent measurement. An example of the method is shown in FIG. 5. The method begins with the directing of a collimated light beam towards directing a collimated beam of light towards a rotating image member (block 200). The light is reflected or scattered by the image member. A portion of the scattered or reflected light is received by an image sensor that generates an image of a portion of the rotating image member (block 204). After at least two images of the image member portion are obtained, a difference is measured between a first image generated by the image sensor and a second image generated by the image sensor (block 208). The difference image is then processed to generate a measurement of the release agent on the rotating image member that corresponds to the measured difference between the first image and the second image (block 210).

In this method various implementations of tasks performed within the method may be achieved. For example, the image difference measurement may be implemented by storing a data value for each photosite in the two-dimensional array at a first and a second time. A difference between the corresponding data values of the two sets of photosite values may be computed and processed to determine a release agent measurement. The generation of the release agent measurement may be achieved, for example, by adding the differences for a portion of differences to generate a sum of image differences. The values for the portion summed may correspond, for example, to a central region of the area on the rotating image member that reflects the collimated light. The difference between a first sum of image differences and a second sum of image differences may be computed and an increment added to a current release agent measurement in response to the measured difference being greater than an incremental threshold.

In another alternative, the release agent measurement includes measuring a size of a central region of the second image, and adding an increment to a release agent measurement in response to the measured size being greater than an incremental threshold. In yet another embodiment, the image difference measurement may be determined by measuring a change in a reflection pattern between the first image and the second image, and adding an increment to a release agent measurement in response to the measured change being greater than an incremental threshold.

Those skilled in the art will recognize that numerous modifications can be made to the specific implementations described above. Therefore, the following claims are not to be limited to the specific embodiments illustrated and described above. For example, the release agent detection and measurement system described above may be used in any printers in which an ink image is generated on an intermediate member and then transferred to another member or media. Such printers include those that use lithographic and rotogravure printing methods. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A system for detecting and measuring release agent on a smooth, rotating image member comprising:

a collimated light source oriented to direct a collimated beam of light generated by the source towards a rotating image member;

an image sensor for generating an image of a portion of the rotating image member from a portion of the collimated beam of light reflected by the rotating image member;

an image differentiator for measuring a difference between a first image generated by the image sensor and a second image generated by the image sensor; and a release agent measurement generator that is coupled to the image differentiator to receive the difference between the two images and to generate a measurement of the release agent on the rotating image member.

2. The system of claim 1, the collimated light source being a laser.

3. The system of claim 2, the laser being a helium-neon laser.

4. The system of claim 2, the laser being a gallium-arsenide laser.

5. The system of claim 1, the collimated light source being an infrared emitter; and the image sensor being an infrared receptor configured to receive specular reflections.

6. The system of claim 1, the image sensor being a two-dimensional array of photosites.

7. The system of claim 5, the image differentiator further comprising:

a first memory for storing a data value for each photosite in the two-dimensional array at a first time;

a second memory for storing a data value for each photosite in the two-dimensional array at a second time;

a differentiator for computing a difference between corresponding data values in the first memory and the second memory; and a third memory for storing the differences between the data values in the first memory and the data values in the second memory.

8. The system of claim 7, the release agent measurement generator further comprising:

a summer for generating an intensity sum by adding the differences stored in a portion of the third memory, the portion of the third memory corresponding to a central region of the area on the rotating image member that reflects the collimated light;

an intensity differentiator configured to measure the difference between a first sum generated by the summer to a second sum previously generated by the summer; and a measurement modifier for adding an increment to a release agent measurement in response to the difference being greater than an incremental threshold.

9. The system of claim 5, the collimated light source being an infrared laser emitter.

10. A method for detecting and measuring release agent on a smooth, rotating image member comprising:

directing a collimated beam of light towards a rotating image member;

generating with an image sensor an image of a portion of the rotating image member from a portion of the collimated beam of light reflected by the rotating image member;

measuring a difference between a first image generated by the image sensor and a second image generated by the image sensor; and generating a measurement of the release agent on the rotating image member that corresponds to the measured difference between the first image and the second image.

11. The method of claim 10, the directing of the collimated light source being the directing of a laser towards the rotating image member.

12. The method of claim 10, the directing of the collimated light source being the directing of an infrared light towards the rotating image member; and the image generation being a measurement of a specular reflection.

13. The method of claim 10, the image generation being reception of the reflected collimated light with a two-dimensional array of photosites.

14. The method of claim 13, the image difference measurement further comprising:

storing a data value corresponding to a first time for each photosite in the two-dimensional array in a first memory;

storing a data value corresponding to a second time for each photosite in the two-dimensional array in a second memory;

computing a difference between corresponding data values in the first memory and the second memory; and storing the differences between the data values in the first memory and the data values in the second memory in a third memory.

15. The method of claim 14, the generation of the release agent measurement further comprising:

adding the differences stored in a portion of the third memory to generate a sum of image differences, the portion of the third memory corresponding to a central region of the area on the rotating image member that reflects the collimated light;

measuring a difference between a first sum of image differences to a previously generated second sum of image differences; and adding an increment to a release agent measurement in response to the measured difference being greater than an incremental threshold.

16. The method of claim 10, the release agent measurement comprising:

measuring a size of a central region of the second image; and adding an increment to a release agent measurement in response to the measured size being greater than an incremental threshold.

17. The method of claim 10, the image difference measurement comprising:

measuring a change in a reflection pattern between the first image and the second image; and adding an increment to a release agent measurement in response to the measured change being greater than an incremental threshold.

* * * * *